United States Patent [19]

Otte

[11] Patent Number: 4,467,526

[45] Date of Patent: Aug. 28, 1984

[54] INCLINATION INSTRUMENT

[75] Inventor: Hubert J. Otte, Toronto, Canada

[73] Assignee: Techdel International Inc., Toronto, Canada

[21] Appl. No.: 388,965

[22] Filed: Jun. 16, 1982

[51] Int. Cl.[3] ..... E21B 47/022; G01C 9/14

[52] U.S. Cl. ..... 33/304; 33/402

[58] Field of Search ..... 33/308, 313, 402, 304, 33/302, 312, 311; 175/45, 25, 26

[56] References Cited

U.S. PATENT DOCUMENTS

| | | | |
|---|---|---|---|
| 2,879,032 | 3/1959 | Whittle | 175/26 X |
| 2,963,099 | 12/1960 | Gianelloni | 175/26 X |
| 4,389,792 | 6/1983 | Fuchs | 33/304 |

*Primary Examiner*—William D. Martin, Jr.

*Attorney, Agent, or Firm*—George A. Rolston

[57] ABSTRACT

Inclination measurement apparatus having a housing, a reference pendulum mounted for swinging about one axis of the housing to respond to deviation of the housing means about such axis, an inclination indicator responsive to the inclination of such housing about another axis, and connected to such reference pendulum, whereby to adopt a predetermined reference position relative to such first axis, a movable locking device operable to restrain movement of such inclination indicator about such transverse axis and being releaseable to permit such movement, the locking device being movable into and out of engagement with the indicator device to secure such indicator device against movement about such transverse axis.

11 Claims, 5 Drawing Figures

INCLINATION INSTRUMENT

The invention relates to the drilling of bore holes in geological strata, and in particular to an instrument for recording the inclination of the drill rods at a predetermined location in the drill hole.

BACKGROUND OF THE INVENTION

When surveying geological strata, for example, drilling is carried out to investigate the nature and content of the strata. In some such drilling, as in oil drilling, the drill hole is simply directed at the strata to be studied and the drilling waste is removed via the surface.

In other types of investigation it is common at a certain stage in the survey work, to conduct what is known as "core drilling". In this procedure a special form of drill bit is used which drills out a donut-shaped portion of the strata leaving a cylindrical portion of the geological strata, called core, which is then stored within a container or core barrel housed within the drill rods. When a certain length of core has been drilled, the core barrel is then withdrawn and the core is removed and the core barrel is then lowered down the hole again.

In this way, it is possible to obtain a continuous section of core down through a geological strata and thus collect accurate information concerning its composition.

It is well known, however, in both core drilling, and other forms of drilling operations, that the drill bit may deviate from the desired drilling direction and inclination, and the inclination of the bore hole will gradually change. As a result, it is impossible to know the precise point and location in the geological strata to which the information relates. This uncertainty reduces the value of the information obtained.

In order to overcome this, various systems are used to measure the inclination of the bore hole. Readings must be taken at various levels down the hole in order to record its inclination throughout its length. One common method is the use of acid, in a glass test tube, the acid etching the tube and indicating the inclination of the hole. This system is carried out during drilling by lowering the tube down the hole to the desired depth, for each reading. There is a predetermined time delay required for the etching process. During this time drilling must be halted. This is time consuming and causes loss of production.

Other systems using the lowering of an instrument can be used. However, these are costly and result in lost production.

Sometimes this information is used to adjust and control the direction of the drill, when drilling is resumed.

It is also possible with some systems that an instrument may be lowered down the hole after drilling has been completed to thus measure the inclination of the completed hole at selected depths. This is an additional operation, which, while it does not delay drilling itself, does involve further time at the drilling site, and additional expense. In addition, if the hole is not measured until drilling is completed, then it is not possible to use the information to correct the inclination of the drill hole to alter its course.

For accuracy in drilling it is desirable to measure the dip angle frequently, at short intervals. However, as a result of the time delays involved in existing measurement systems it is the usual practice to measure only at intervals of about one hundred feet. Any shorter interval becomes prohibitively expensive.

In the case of core drilling it would be a considerable improvement over this procedure, if an instrument were included in the drill rods at the time the core was being drilled out. The instrument would measure the inclination of the hole so that when the core barrel was removed from the hole, the inclination of the hole at that depth could be recorded. Core barrels vary in length but are commonly between ten and twenty feet. If the measuring instrument gave a reading each time the core barrel was removed, this would greatly increase the frequency of measurement, during drilling. This in turn would result in more accurate information, and would enable the driller to correct the inclination if desired.

One of the problems involved in designing such an instrument is that the drill rods and the core barrel during the drilling procedure rotate at a predetermined speed necessary for drilling through the strata. Thus, any instrument which is incorporated in the drill rods must be capable of withstanding extended periods of relative rapid rotation, and at the end of such movement, being then capable of taking an accurate reading of the inclination of the hole at that level, before the core barrel is removed. In addition, the inclination reading taken must be preserved so as to be capable of being recorded when the core barrel is brought to surface.

Similar problems arise in measuring inclination in other drilling operations, where cores are not obtained. In this case such an instrument would desirably be incorporated in the drill rods, so that readings could be taken each time the rods were removed, without having to lower an instrument down the hole as a separate operation.

In the past, no instrument suitable for this purpose has been available to the industry, and these functions have not been performed.

BRIEF SUMMARY OF THE INVENTION

The invention seeks to provide the foregoing features and overcome the various disadvantages by the provision of an inclination measurement apparatus, for inclusion in a system of drill rods for insertion in and removal from a bore hole in a geological strata and comprising housing means, reference pendulum means swingably mounted axially of said housing means, and swingable to respond to rotational deviation of said housing means, inclination indicator means responsive to the inclination of such housing means, movable locking means operable to restrain movement of such indicator means, and being releasable to permit such movement, movement means connected to said locking means for moving same into and out of engagement with said indicator means, and being operable to secure such indicator means against movement during removal from such bore hole.

More particularly, the invention seeks to provide an inclination instrument having the foregoing advantages including delay means incorporated in such instrument, delaying the operation of such locking means on such indicator means, for a predetermined time period after cessation of rotation of said housing, thereby permitting said indicator means to come to rest and provide an accurate reading of the inclination of such core prior to engagement of said locking means with said indicator means.

More particularly, it is an objective of the invention to provide an instrument having the foregoing advantages wherein means are provided giving a visual readout of the position of such indicator means.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

For the purposes of this description it is assumed the invention is to be used in association with a typical core drilling rig using tubular drill rods, and a core barrel contained within such drill rods.

Such equipment is widely used in the industry and accordingly the details are omitted for the sake of clarity.

It will be understood that the invention is not limited solely to core drilling. Such an instrument may be used in a variety of different types of drilling operation, with or without the use of core barrels, and regardless of whether the drilled material is recovered or simply disposed of as waste.

Figure 1:
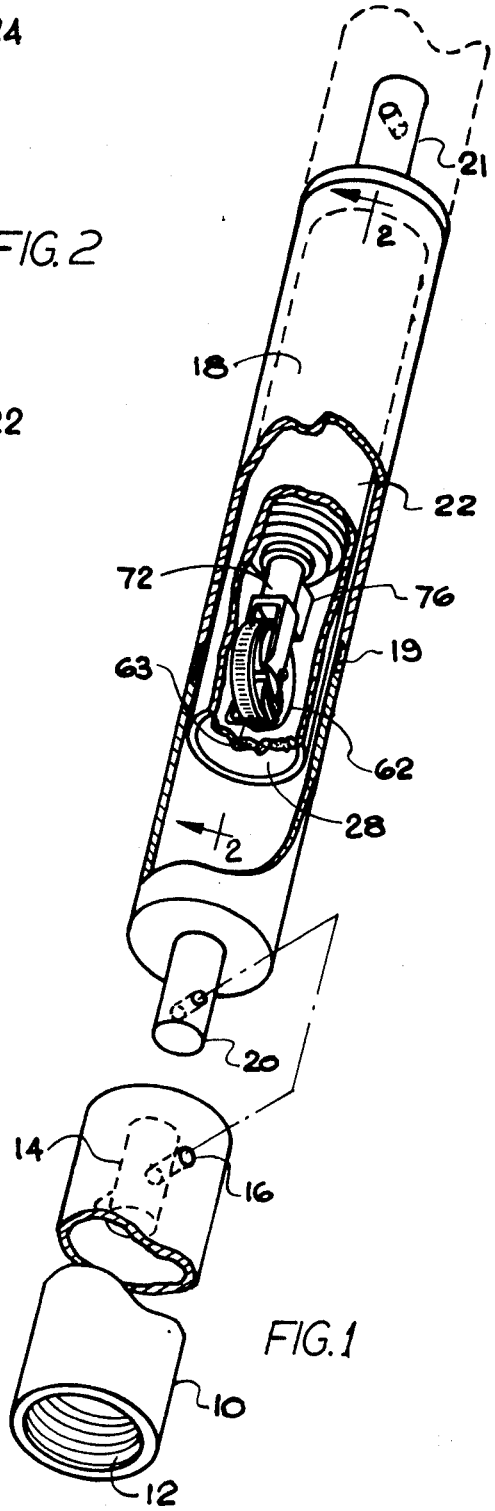
FIG. 1 is a perspective illustration in schematic form showing the general arrangement of a portion of a drill rod, and the drill bit and core housing assembly thereof.

Referring now to FIG. 1, a hollow core barrel section is shown generally as 10, which may have any suitable union means such as threads 12 for interconnection with adjacent lengths of core barrel.

Normally, the core barrel 10 has a bore 14 and spring retainer 16 for attachment of a so-called "spear" or fastening pin (not shown). Such a pin is adapted to receive a suitable coupling on a hoisting cable, so that the core barrel can be raised and lowered within the hollow drill rods. The core barrel will receive the core of geological material which is drilled out by the drill bit itself (not shown).

The inclination instrument according to the invention is located within a protective outer case or housing 18 having two parts separable at threads 19. A lower coupling pin 20 is provided for reception in recess 14, for releaseable attachment to barrel 10. An upper coupling pin 21 is provided for releaseable connection to a hoisting cable (not shown).

Figure 2:
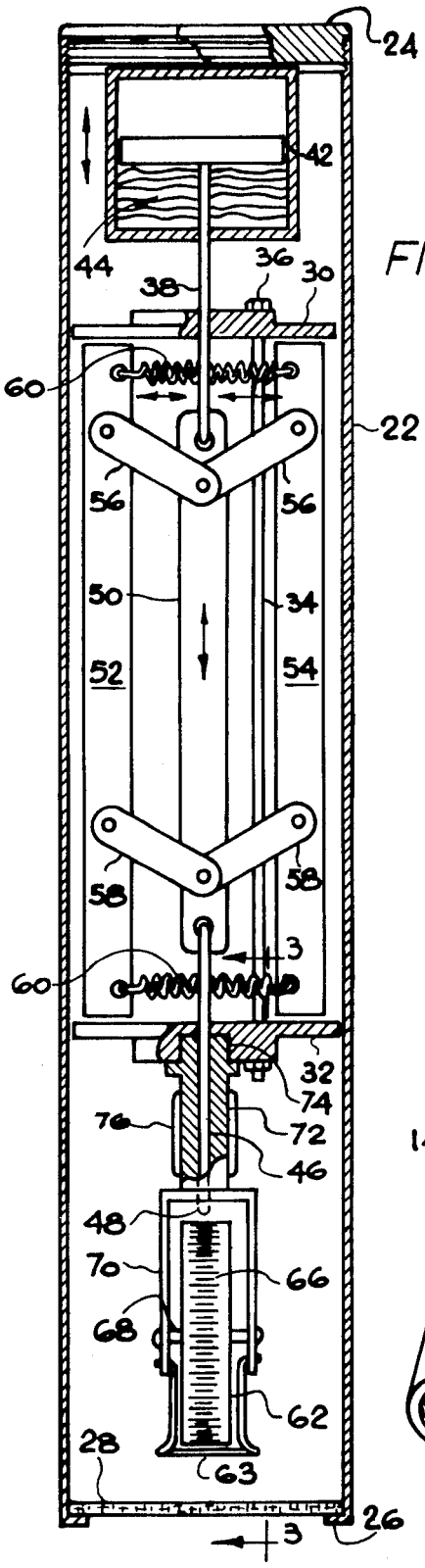
FIG. 2 is a section along 2—2 of FIG. 1.
Figure 3:
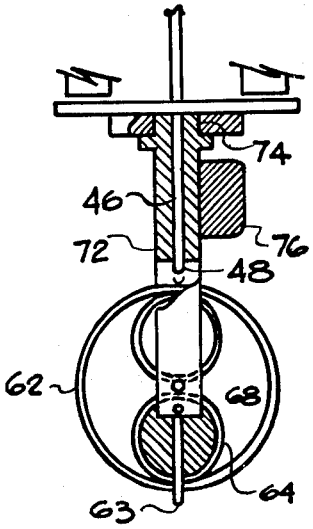
FIG. 3 is a section along 3—3 of FIG. 2.

As best shown in FIGS. 2 and 3, the instrument comprises a generally cylindrical metal housing 22, having upper and lower ends 24 and 26, the lower end 26 being provided with a transparent viewing window 28 for reasons to be described.

Typically, one end of the housing will be removable, for access to the instrument located within the interior.

The instrument is located within an inner sleeve or housing 22, and will be seen to comprise an essentially open framework consisting of upper and lower end plates 30 and 32, which may be secured within the housing 22, or which may be secured together in predetermined spaced apart relationship by means such as a plurality of struts 34. It will be appreciated that only one such strut 34 is shown, although there may in practice be several such struts. Such struts may be secured in position, such as by means of threaded fastenings 36 or the like. Other forms of construction may replace this arrangement, which is not critical.

An upper operating rod 38 extends through upper plate 30, through a suitable low friction bushing (not shown), and is connected to a damping means, in this case a damping cylinder 40. Rod 38 is fastened to damping piston 42 within cylinder 40, which is filled with any suitable damping medium such as damping fluid 44. Suitable restricted ports (not shown) will be provided where necessary, essentially similar to the construction of an automobile shock absorber, whereby downward movement of piston 42 is damped and delayed by the fluid 44, whereas upward movement of piston 42 may take place more readily. Any other form of damping means may be suitable.

A lower operating rod 46 extends through lower plate 32, being provided with a suitable low friction bushing of any suitable design (not shown). Operating rod 46 terminates in a rounded, contact surface 48, the purposes of which will be described later.

Connecting between the operating rods 38 and 46, is a connector rod or plate 50. Rod 50 may be of any suitable design, typically being in this case a flat metal plate or bar. A body means, in this case a pair of weights, of a predetermined mass, indicated as 52 and 54, are provided on opposite sides of rod 50, and are connected thereto by means such as scissors linkage 56 and 58. Weights 52 and 54 are free to move outwardly and inwardly within the confines of plates 30 and 32. They are biased inwardly by means of any suitable biasing means such as the springs 60.

It will be appreciated that for the purposes of this explanation only two such weights 52 and 54 are shown.

However, the invention is not specifically limited to any number of weights, and conceivably a single weight, or in some cases, more than two weights, may be utilized. The sole purpose of the weights is to take advantage of the centrifugal force created by the rotation of the drill rods, in a manner to be described below.

Other means of guiding the weights could be used such as guide rods and bushings (not shown) extending through bores in the weights.

Similarly, while the biasing means is shown extending between such weights, it will of course be appreciated that the biasing means could be in the form of springs, or any other suitable biasing means, at any other part in the linkage, and could, for example, be located in the upper part of cylinder 40, or at any other location providing a suitable biasing force.

The instrument further comprises a plumb bob rotor member 62, which is eccentrically weighted, typically by means of lead or the like, as at 64. Suitable gradations or markings 66 are provided on the perimeter.

Frictionless bearings are provided for the axis 68 of rotor 62, which is located transversely of the axis of the housing.

A mounting frame 70 which carries the axis 68 and rotor 62 is itself connected by means of a stem 72, which is rotatably fastened to lower plate 32 at bushing 74.

A reference weight or pendulum 76 is attached to stem 72, to ensure that stem 72 is always rotated so that rotor 62 lies in a vertical plane. The gradation 66 of rotor 62 will be visible through window 28.

In operation, the instrument is attached to the upper end of the hollow core barrel 10, substantially as shown in FIG. 1. The instrument and the core barrel are then lowered down the drill rods on a cable prior to the commencement of drilling. During drilling rotation may take place at anywhere from 400 to greater than 2,000 r.p.m., depending upon the type of strata being drilled.

During such rotation, the centrifugal force created by the rotary movement will cause weights 52 and 54 to move outwardly away from one another. Due to the guiding means, namely the upper and lower plates 30 and 32, such outward movement will thus cause the linkages 56 and 58 to move connecting rod 50 upwardly towards cylinder 40. Such upward movement will cause upper operating rod 38 to move piston 42 upwardly in cylinder 40. Simultaneously, it will cause the lower operating rod 46 to move upwardly away from the rotor 62.

Weights 52 and 54 will thus continue to be held outwardly continuously during drilling.

As soon as rotation of the drill rods is halted, the centrifugal force will no longer exist. The biasing means, namely springs 60, will thus reassert themselves, and draw weights 52 and 54 inwardly towards one another. This will cause connecting rod 50 to move downwardly towards rotor 62. However, it is undesirable that such downward movement should take place immediately.

Accordingly, damping fluid 44 within cylinder 40, restrains downward movement of piston 42, and consequently such downward movement of operating rod 38 and connecting rod 50, and operating rod 46, are all restrained due to the damping influence of the fluid 44.

During this time delay, while there is no rotation of the drill rods taking place, reference weight 76 will locate plumb bob rotor 62 in a vertical plane and the rotor 62 is thus free to swing about its transverse axis. The weighted portion 64 thereof will respond to gravity, and come to rest at the lowermost point.

The oscillation of rotor 62 is completed relatively quickly, in a matter of a few seconds. As and when such movement has been completed, the controlling and restraining influence of the damping fluid 44 is so arranged that it will permit piston 42 to sink slowly downwardly in cylinder 40. This will thus cause operating rod 46 to move downwardly, and contact surface 48 of rod 46 will then come into contact with plumb bob rotor 62. Rotor 62 will then be securely locked and held in position, and the rotor 62 will thus give a precise reading of the angle of the core barrel at that point.

The core barrel and instrument are then withdrawn from the drill rods, and the drill core is extracted from the core barrel. A reading is taken from the plumb bob 62 and is recorded in respect of the particular length of core which has just been drilled and extracted.

The instrument and the core barrel are once again lowered down the drill rods to receive a further length of core, as it is drilled out.

It will be understood that there is no need whatever for workmen to reset the instrument or to touch it in any way, other than to take a reading through window 28.

The instrument will simply be lowered with the core barrel, and once the drill rods start rotating again, the weights 52 and 54 will again move outwardly, releasing plumb bob 62 once more, so that it can take another reading at the next level.

It will of course be appreciated that in certain circumstances various modifications may be made to the invention to make it adaptable to different situations.

For example, in some cases it may be desirable to take inclination readings without in fact rotating the drill rods to procure the centrifugal forces necessary to move the weights.

Figure 4:
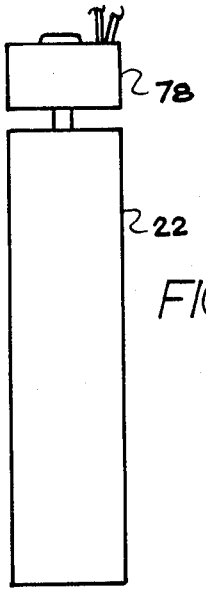
FIG. 4 shows an alternate embodiment.

In this case for example an embodiment such as that shown in FIG. 4 might be employed in which the entire housing 22 is coupled by a suitable shaft to any form of rotary motive power such as an electric motor or hydraulic or pneumatic rotor or the like, indicated generally as 76. The remaining interior of the instrument as shown in FIG. 2 would be the same.

When this device is lowered down a borehole, the weights 52 and 54 would of course be drawn inwardly by the springs 60, thereby applying restraining force to the rotor 62, locking it in position.

However, as soon as the motor 76 was operated to rotate the housing 22 at a sufficient speed, the weights 52 and 54 would move apart, thereby freeing the rotor 62.

Once the motor 76 was stopped, the device would then read the inclination of the hole in the manner already described.

This might be of particular utility in certain drilling situations where drills are used of the type which are rotated by a form of rotary motive power which is mounted on the drill rods adjacent the drill bit (such drilling systems typically employ rotors operated by hydraulic means, the hydraulic medium being pumped down the drill shaft from the surface, and being converted through a hydraulic rotor into rotary power which thus rotates the drill bit). Drills of this type are currently employed in, for example, oil drilling and the like.

Figure 5:
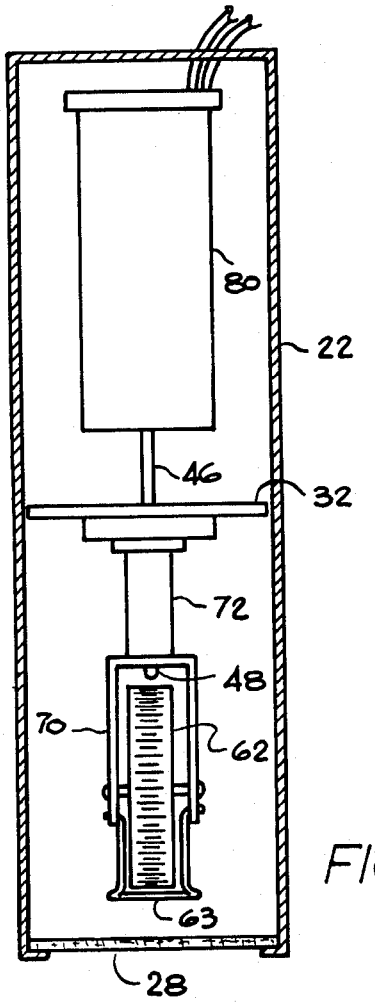
FIG. 5 shows a further alternate embodiment.

In still other circumstances it may be desirable to do away with the use of the weights 52 and 54 altogether, and to provide some other movement means for moving the locking means, or rod 46. In this case, the embodiment as shown in FIG. 5 might be utilized. In this case an electric or other solenoid or plunger device 78 is provided, which may be operated by any suitable controls at the surface, so as to move a locking means such as the rod 46 into and out of engagement with the rotor 62.

In this way readings can be taken without the necessity of rotating the housing 22 at all.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. Inclination measurement apparatus for insertion in and removal from a remote location and comprising;

housing means having a longitudinal axis and a transverse axis;

reference pendulum means mounted for swinging about said longitudinal axis of said housing means to respond to deviation of said housing means about such axis;

inclination indicator means responsive to the inclination of such housing means about such transverse axis, and connected to such reference pendulum means, whereby to adopt a predetermined reference position relative to such longitudinal axis;

movable locking means operable to restrain movement of such indicator means about such transverse axis and being releaseable to permit such movement, and, movement means connected to said locking means and responsive to rotation of said housing at a predetermined speed, to move said locking means away from said inclination indicator means, and, upon cessation of such rotation, said movement means being operable to move said locking means back into locking engagement with said indicator means.

2. Inclination measurement apparatus as claim in claim 1 including movement control means for controlling the speed of movement of said movement means, whereby to establish a predetermined time delay, for movement of said inclination indicator means, and during which such means shall be capable of coming to rest, thereby obtaining a true reading of such inclination.

3. Inclination measurement apparatus as claimed in claim 1 including cylinder means containing a fluid damping medium, and piston means movable within said cylinder means, said piston means being connected to movement means.

4. An inclination indicator, for use in association with a core barrel in a drilling rig for insertion in and removal from a bore hole in a geological strata and comprising;

a housing of a predetermined diameter adapted to be received within said bore hole;

inclination indicator means within said housing responsive to the inclination of such housing; movable locking means operable to restrain movement of such indicator means, and being releaseable to permit such movement and responsive to rotation of said housing at a predetermined speed, to move said locking means away from said inclination indicator means, and upon cessation of such rotation, being operable to move said locking means back into locking engagement with said indicator means, and, attachment means on said housing for connection to said barrel.

5. An inclination indicator as claimed in claim 4 including releaseable coupling means on said housing, remote from said attachment means, for coupling to a hoisting system, whereby said housing and said core barrel may be removed simultaneously.

6. An inclination indicator as claimed in claim 5, wherein said housing comprises an outer casing, and means for opening said casing, and wherein said inclination indicator means and said movable locking means are located within one portion of said housing.

7. An inclination indicator as claimed in claim 6 including window means in said portion of said housing, for viewing said inclination indicator means, and thereby taking a reading of the inclination of said borehole.

8. An inclination indicator, for inclusion in a system of drill rods for insertion down a bore hole in a geological strata and comprising;

a housing of a predetermined diameter adapted to be received within said bore hole and rotatable in unison with such drill rods;

inclination indicator means responsive to the inclination of such housing;

movable locking means operable to restrain movement of such indicator means, and being releaseable to permit such movement;

body means providing a mass responsive to rotation of said housing, and being movable outwardly and inwardly with respect to the axis of said housing;

biassing means normally urging said body means inwardly, and yielding to rotational movement of said housing at a predetermined speed, whereby to permit said body means to move outwardly, and, linkage means interconnecting said body means and said locking means, whereby to release said locking means from said indicator means upon outward movement of said body means during rotation of said housing, and said locking means being movable to restrain said indicator means upon inward movement of said body means.

9. An inclination indicator as claimed in claim 8 including damping means connected with said linkage means, and being operable to control the speed of movement of said locking means in the locking direction.

10. An inclination indicator as claimed in claim 8 wherein said body means comprises two body members located within said housing, adjacent and on opposite sides of said axis thereof, and being movable in opposition to one another outwardly with respect to said axis upon rotation of said housing, and moving inwardly towards one another and towards said axis upon cessation of rotation of said housing.

11. An inclination indicator as claimed in claim 8 wherein said inclination indicator means is freely rotatable within said housing, and including reference pendulum means coupled to said inclination indicator means, said reference pendulum means adopting a predetermined reference orientation when said housing is brought to rest.

* * * * *